US008116466B2

(12) United States Patent
Zhou et al.

(10) Patent No.: US 8,116,466 B2
(45) Date of Patent: Feb. 14, 2012

(54) APPARATUS AND METHOD FOR TESTING SOUND INPUT AND OUTPUT OF SOUND CARD

(75) Inventors: Hong-Liang Zhou, Tianjin (CN); Ding-Hao Zhang, Tianjin (CN); Ding-Zhuo Wang, Tianjin (CN); Tom Chen, Taipei (TW); Win-Harn Liu, Taipei (TW)

(73) Assignee: Inventec Corp., Taipei (TW)

( * ) Notice: Subject to any disclaimer, the term of this patent is extended or adjusted under 35 U.S.C. 154(b) by 1181 days.

(21) Appl. No.: 11/902,297

(22) Filed: Sep. 20, 2007

(65) Prior Publication Data

US 2009/0080668 A1 Mar. 26, 2009

(51) Int. Cl.
*H04R 29/00* (2006.01)

(52) U.S. Cl. ..... 381/58; 381/59

(58) Field of Classification Search ..... 381/58, 381/59

See application file for complete search history.

(56) References Cited

U.S. PATENT DOCUMENTS

2008/0144847 A1* 6/2008 Chen et al. ..... 381/58
2009/0086985 A1* 4/2009 Zhang et al. ..... 381/58

* cited by examiner

*Primary Examiner* — A O Williams
(74) *Attorney, Agent, or Firm* — James W. Huffman

(57) ABSTRACT

An apparatus and a method for testing a sound card are applicable for detecting whether a sound leakage problem occurs to a sounding interface of the sound card. The testing apparatus includes a switching circuit and a switching unit. The switching circuit is electrically connected to the sounding interface and a sound-receiving interface of the sound card respectively, and has a plurality of transfer paths. The switching circuit is used to receive a first and a second sound channel, and to connect the first and the second sound channel to corresponding transfer paths, so as to transmit the audio signal back to the sound-receiving interface. The switching unit is electrically connected to the sounding interface and the switching circuit, for receiving the first and the second sound channel. The switching unit alters the transfer paths in the switching circuit according to a first and/or a second switching audio signal.

13 Claims, 6 Drawing Sheets

APPARATUS AND METHOD FOR TESTING SOUND INPUT AND OUTPUT OF SOUND CARD

BACKGROUND OF THE INVENTION

1. Field of the Invention

The present invention relates to an apparatus and a method for testing a sound card. More particularly, the present invention relates to an apparatus and a method for testing a sound card, applicable for detecting whether a sound leakage problem occurs between sound channels of the sound card.

2. Related Art

The sound card is an indispensable periphery in a personal computer (PC). Besides offering the common functions of playing music and movies, the sound card is also applied in sound input, for example, sound recording, sound input for voice over IP (VoIP).

A conventional manner for testing the sound card is that, the sound card is installed on the PC, and individual sound channels are connected to corresponding speakers via different signal lines, or the signal lines are connected to microphone input ends of the corresponding sound channels, for example, a left channel output is connected to a left channel input. A sound card testing program on a control unit sends a testing audio signal to each sound channel one by one, and according to the sound sent by the testing program to each sound channel, the tester listens to the sound emitted from the corresponding speaker, so as to determine whether an error occurs or not.

As for the above testing manner, the signal lines must be installed manually one by one, and in addition, the testers must pay more attention to the testing audio signal generated by the testing program. Therefore, the following problems easily occur during the testing process. Firstly, if the testers do not note the testing sound generated by one of the speakers, they have to listen to the sound from each speaker once again. Secondly, if the signal lines of a single sound card is replaced frequently, the interface end of the sound card may be loosen, and the sound card easily generates unnecessary noises, so as to affect the testing result. Furthermore, the output interfaces in the current sound card are gradually increased (for example, 5.1-channel or 7.1-channel), such that the manual listening process is quite time-costing.

SUMMARY OF THE INVENTION

In view of the above problems, the object of present invention is provided with an apparatus for testing a sound card, capable of detecting whether a sound leakage problem occurs in a sounding interface of the sound card in the PC by using a mono/dual-channel sound-receiving unit.

In order to achieve the above object, the apparatus for testing the sound card provided by the present invention includes a switching circuit and a switching unit.

The switching circuit is electrically connected to a sounding interface and a sound-receiving interface of the sound card respectively, and has a plurality of transmitting paths. The switching circuit is used to receive a first sound channel and a second sound channel, and to connect the first sound channel and the second sound channel to corresponding transmitting paths, so as to transmit the audio signal back to the sound-receiving interface. The PC monitors a first testing audio signal transmitted via the first sound channel and/or a second testing audio signal transmitted via the second sound channel, and examines whether the first sound channel has the second testing audio signal or whether the second sound channel has the first testing audio signal, so as to determine whether the sound leakage problem occurs between the first sound channel and the second sound channel. The switching unit is electrically connected to the sounding interface and the switching circuit respectively, for receiving the first sound channel and the second sound channel. The switching unit alters the transmitting paths in the switching circuit according to a first switching audio signal and/or a second switching audio signal.

From another aspect of the present invention, the present invention provides a method for testing a sound card, applicable for detecting whether the sound leakage problem occurs in the sounding interface of the sound card in the PC. The sounding interface includes a first sound channel and a second sound channel respectively, and the testing method includes the following steps. Firstly, a switching unit and a switching circuit are provided, in which the switching unit is electrically connected to the sounding interface and the switching circuit respectively, and the switching circuit is electrically connected to the sounding interface and a sound-receiving interface in the sound card respectively. Next, the PC sends a first switching audio signal to the first sound channel or the second sound channel. Then, the switching unit alters the transmitting paths in the switching circuit according to the first switching audio signal, and connects the first sound channel and the second sound channel to the corresponding transmitting paths, so as to transmit the audio signal back to the sound-receiving interface. Then, the PC monitors whether the first sound channel has the testing audio signal transmitted via the second sound channel and monitors whether the second sound channel has the testing audio signal transmitted via the first sound channel.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, which thus is not limitative of the present invention, and wherein.

DETAILED DESCRIPTION OF THE INVENTION

The apparatus for testing the sound card provided by the present invention is used to detect whether the sound leakage problem occurs in the sounding interface and the sound-receiving interface of the sound card in the PC. A testing apparatus 130 includes a switching unit 131 and a switching circuit 133.

Figure 1:
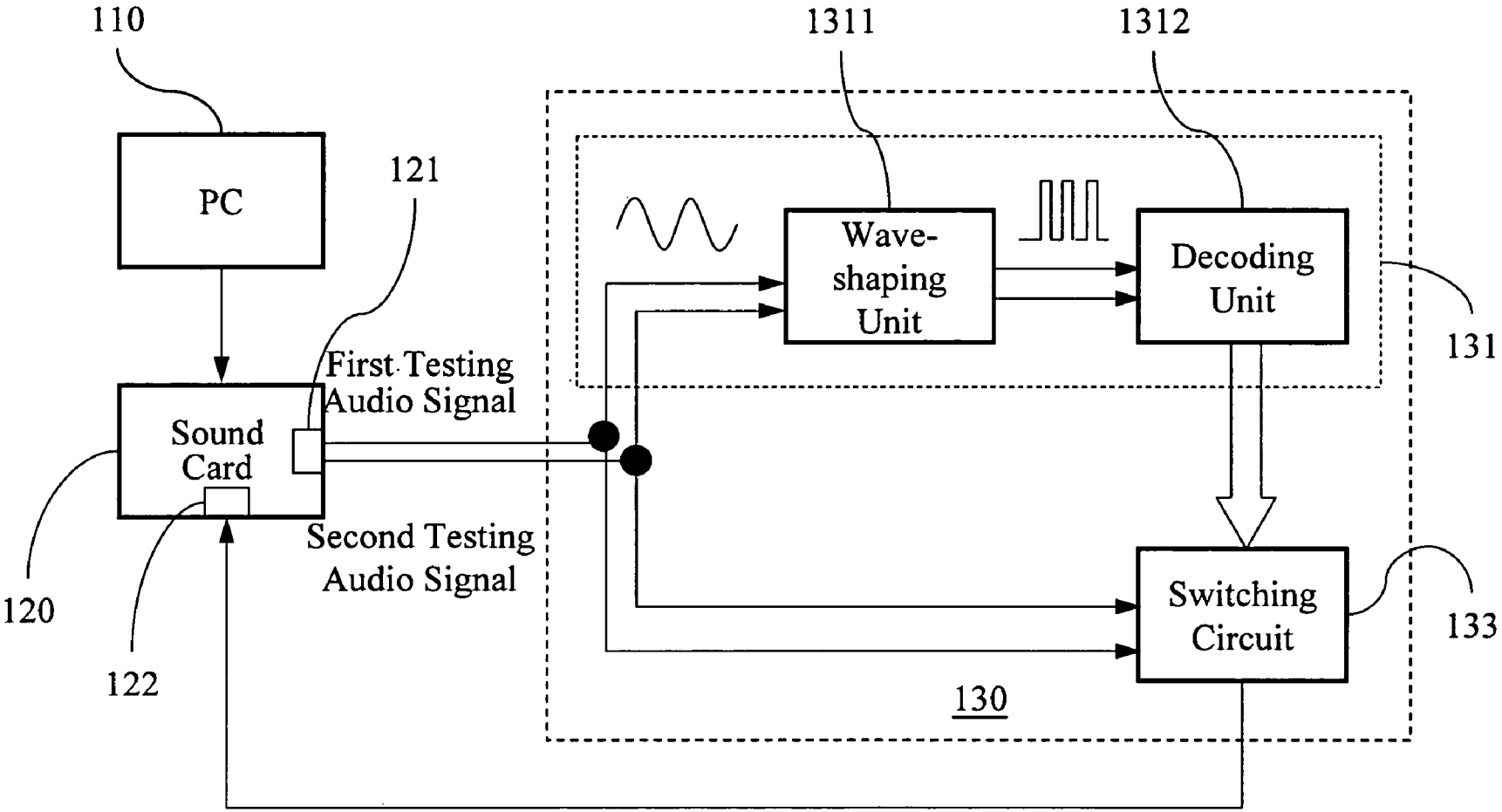
FIG. 1 is a schematic view of a preferred embodiment of the present invention.

Referring to FIG. 1, it is a schematic view of a preferred embodiment of the present invention. The switching unit 131 is electrically connected to a sounding interface 121 and a switching circuit 133 respectively. Firstly, a sound card 120 is installed on a PC 110, and the sound card 120 in this embodiment is not limited to a certain interface, but can be any one of an ISA interface, a PCI interface, or a USB interface. Herein, a dual-channel sound card 120 is taken as an example for demonstration in this embodiment. The sound card 120 further includes the sounding interface 121 and the sound-receiving interface 122, and the sounding interface 121 is used to transmit audio signals. In this embodiment, the dual-channel sound card 120 is taken as an example, so the sounding interface 121 respectively provides a first sound channel (not shown) and a second sound channel (not shown). The first sound channel is used to transfer a first switching audio signal, a second switching audio signal, and a first testing audio signal, the second sound channel is used to transfer the first switching audio signal, the second switching audio signal, and the second testing audio signal. The audio signals can be music segments or specific waveforms, for example, sine waves or successive square waves.

The switching unit 131 is used to receive the first sound channel and the second sound channel, and to alter the transmitting paths in the switching circuit 133 according to the first switching audio signal and/or the second switching audio signal. The switching unit 131 further includes a wave-shaping unit 1311 and a decoding unit 1312. The wave-shaping unit 1311 is electrically connected to the sounding interface 121 and the decoding unit 1312. The wave-shaping unit 1311 can be, but not limited to, a 555 timer. The wave-shaping unit 1311 is used to receive the first audio signal and the second audio signal, and to convert the received audio signals into corresponding switching signals.

The decoding unit 1312 controls the path constitution of the connecting circuit according to the switching signals. The decoding unit 1312 can be, but not limited to, a multi-path select circuit formed by a PT2272 decoder. The 555 timer converts a specific audio file (a sine wave or a music segment) sent from the sound card 120 into a corresponding waveform and outputs the waveform to the PT2272 decoder. Then, the PT2272 decoder selects a corresponding transmitting path according to the waveform.

The switching circuit 133 is electrically connected to the sounding interface 121 and the sound-receiving interface of the sound card 120 respectively, and has a plurality of transmitting paths. The switching circuit 133 is used to receive the first sound channel and the second sound channel, and to connect the first sound channel and the second sound channel to the corresponding transmitting paths, so as to transmit the audio signal back to the sound-receiving interface. The sound-receiving interface is a mono-channel sound input interface or a dual-channel sound input interface. Generally, besides the microphone input, the sound-receiving interface also refers to line-in. Based upon a frequency domain comparison method, the PC 110 can determine whether the audio signal received by the sound-receiving interface is consistent with the audio signal sent via the sound channel, thereby determining whether the noise interference problem occurs in each sound channel during transmission. The frequency domain comparison method can be, but not limited to, Fourier convert, wavelet convert, or designs of discrete cosine convert. Once receiving the switching signal, the decoding unit 1312 switches the first sound channel and the second sound channel to the corresponding transmitting path, such that the testing audio signal can be transmitted back to the PC 110. The PC 110 monitors the first testing audio signal transmitted via the first sound channel and/or the second testing audio signal transmitted via the second sound channel. The PC 110 examines whether the first sound channel has the second testing audio signal or whether the second sound channel has the first testing audio signal, so as to determine whether the sound leakage problem occurs between the first sound channel and the second sound channel.

Figure 2:
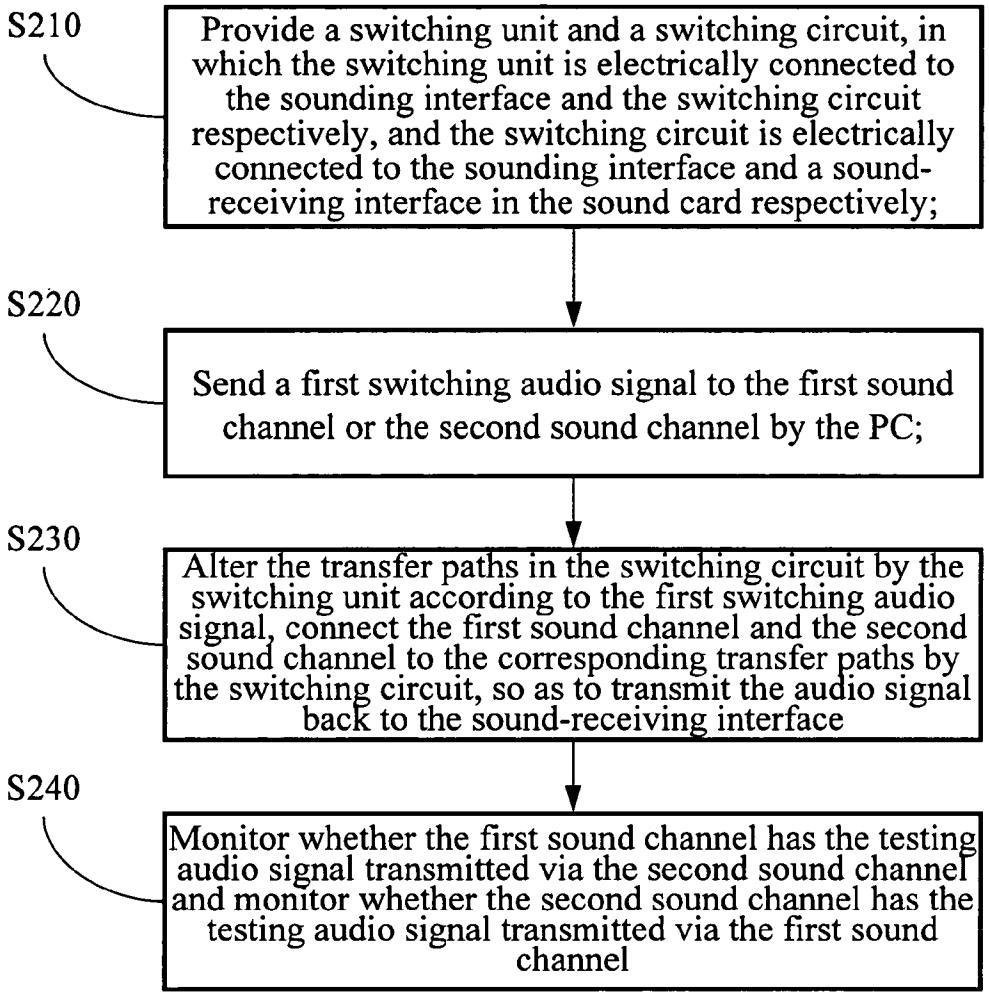
FIG. 2 is a flow chart of the operation of the present invention.

Referring to FIG. 2, it is a flow chart of the operation of the present invention. The testing method includes the following steps. A switching unit and a switching circuit are provided, in which the switching unit is electrically connected to the sounding interface and the switching circuit respectively, and the switching circuit is electrically connected to the sounding interface and the sound-receiving interface in the sound card respectively (Step S210). Next, the PC sends the first switching audio signal to the first sound channel or the second sound channel (Step S220). Then, the switching unit alters the transmitting paths in the switching circuit 133 according to the first switching audio signal, and connects the first sound channel and the second sound channel to the corresponding transmitting paths, so as to transmit the audio signal back to the sound-receiving interface (Step S230). Then, the PC monitors whether the first sound channel has the testing audio signal transmitted via the second sound channel and whether the second sound channel has the testing audio signal transmitted via the first sound channel (Step S240), thereby examining whether the sound leakage problem occurs between the first sound channel and the second sound channel. In order to clearly demonstrate the operation steps for detecting the sound leakage in the present invention, refer to FIGS. 3*a* and 3*b*, they are respectively demonstrative schematic views of the flow when the present invention is applied to a dual-channel sound-receiving unit according to an embodiment of the present invention. Herein, the dual-channel sound-receiving interface 122 is used as the sound input for the PC 110. The connection of each element in this embodiment is mostly similar to that mentioned in the above description, which thus is not described herein any more.

Figure 3A:
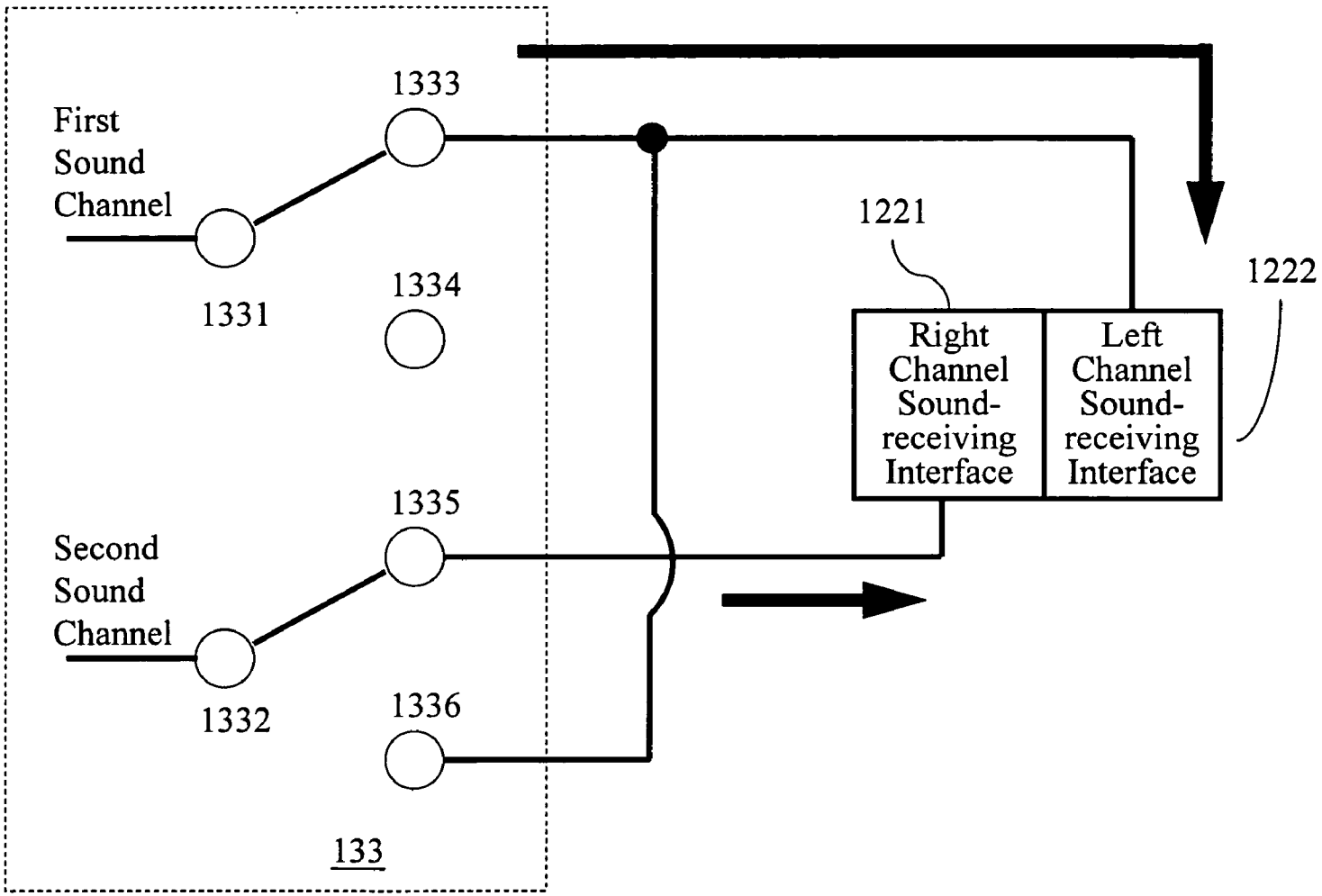
FIG. 3*a* is a demonstrative schematic view of the flow when the present invention is applied to a dual-channel sound-receiving unit according to an embodiment of the present invention.
Figure 3B:
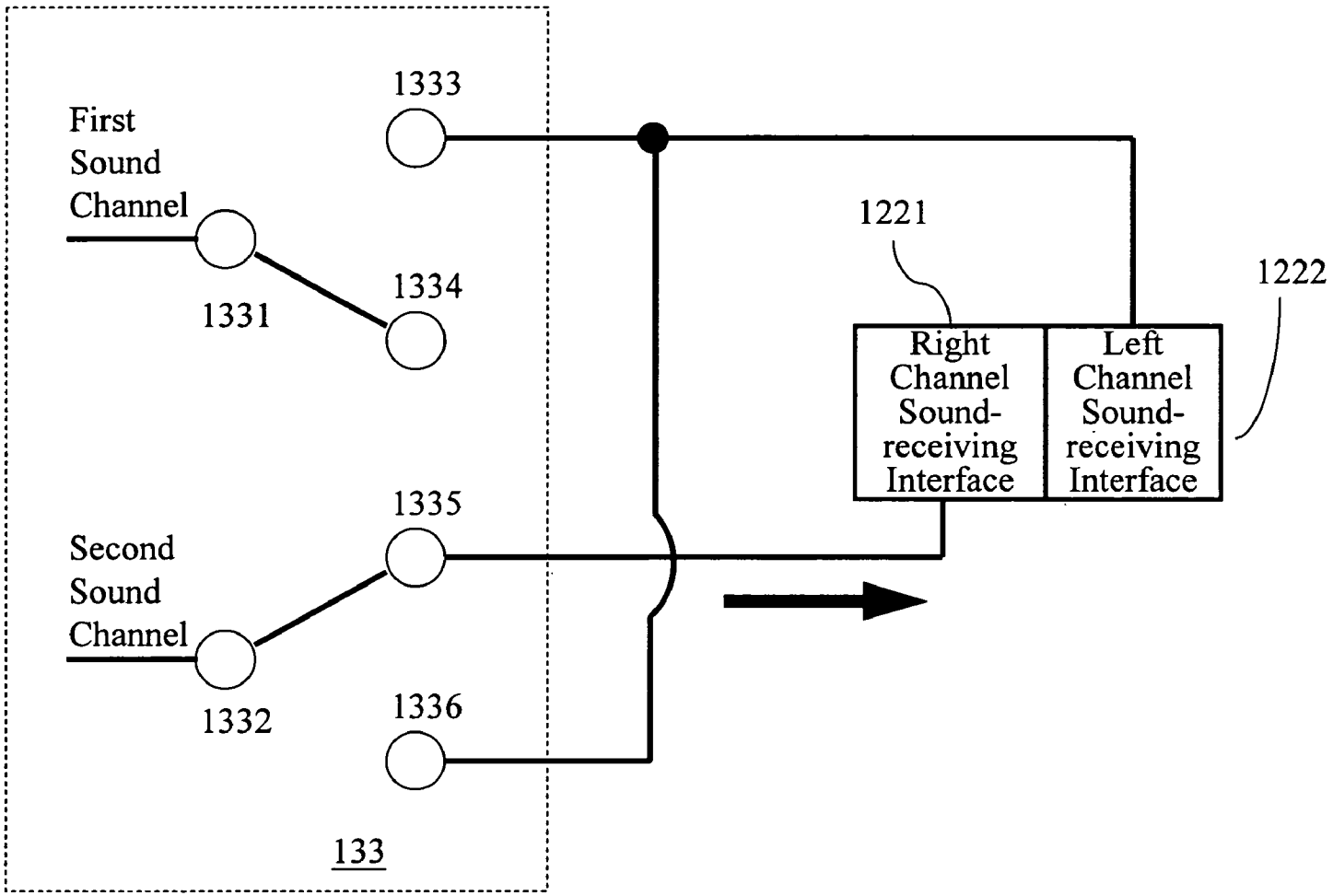
FIG. 3*b* is a demonstrative schematic view of the flow when the present invention is applied to the dual-channel sound-receiving unit according to an embodiment of the present invention.

It should be particularly noted that, the connecting circuit in FIG. 3*a* is electrically connected to the first sound channel, the second sound channel, and the sound-receiving interface 122 respectively. In FIG. 3*a*, the first sound channel is respectively connected to two corresponding transmitting paths. The first transmitting path is connected to the sound-receiving interface 122 (that is, a node 1331 is connected to a node 1333, so as to be connected to the left channel sound-receiving interface 1222), and the second transmitting path is idle (that is, the node 1331 is connected to a node 1334). The second sound channel has one transmitting path, a third transmitting path is electrically connected to the sound-receiving interface 122 (that is, a node 1332 is connected to a node 1335, so as to be connected to the right channel sound-receiving interface 1221).

In this embodiment, the manner for the switching unit 131 to alter the transmitting paths in the switching circuit 133 is to take the first transmitting path and the third transmitting path as a group of transmitting paths. Once receiving the first switching audio signal, the switching unit 131 alters the transmitting paths into a configuration shown in FIG. 3*a*. Once receiving the second switching audio signal, the switching unit 131 alters the transmitting paths into a configuration shown in FIG. 3*b*. Firstly, the first sound channel is tested, and it is assumed that the first testing audio signal is a sine wave of 20 Hz. The PC 110 sends the first testing audio signal via the first sound channel, and the first sound channel is connected to the left channel sound-receiving interface 1222, so the left channel sound-receiving interface 1222 can only receive the first testing audio signal. If the PC 110 analyzes that other sounds are also existed through the frequency domain analyzing method, it represents that the sound leakage problem occurs between the first sound channel and the left channel sound-receiving interface. Furthermore, the PC 110 can add the second testing audio signal of 2000 Hz into the second sound channel. When the PC 110 analyzes the left channel sound-receiving interface 1222, if it is in the normal condition, only a sine wave of 20 Hz exists. If it is detected that a sine wave of 2000 Hz also exists, it represents that the sound leakage problem exists between the first sound channel and the second sound channel.

The second sound channel can also be tested through the above manner, that is, it is assumed that the first testing audio signal is a sine wave of 20 Hz. The PC 110 sends the first testing audio signal through the second sound channel, and the second sound channel is connected to the right channel sound-receiving interface 1221, so the right channel sound-receiving interface 1221 can only receive the first testing audio signal. If the PC 110 analyzes that other sounds are also existed through the frequency domain analyzing method, it represents that the sound leakage problem occurs between the second sound channel and the right channel sound-receiving interface. Furthermore, the PC 110 can add the second testing audio signal of 2000 Hz into the first sound channel. When the PC 110 analyzes the right channel sound-receiving interface 1221, if it is in the normal condition, only a sine wave of 20 Hz exists. If it is detected that a sine wave of 2000 Hz also exists, it represents that the sound leakage problem occurs between the second sound channel and the first sound channel. If it intends to test the second sound channel more accurately, the connecting manner of the transmitting paths can be obtained with reference to FIG. 3*b*. Firstly, the PC 110 sends the first switching audio signal and the second switching audio signal to respectively switch and connect the node 1331 to the node 1334, and to connect the node 1332 to the node 1335. At this time, the first sound channel is idle, which does not output any testing audio signal to the sound-receiving interface 122, and the second sound channel is connected to the right channel sound-receiving interface 1221.

Similarly, it is assumed that the first testing audio signal is a sine wave of 20 Hz. The PC 110 sends the second testing audio signal via the second sound channel, and the second sound channel is connected to the right channel sound-receiving interface 1221, so the right channel sound-receiving interface 1221 can only receive the second testing audio signal. If the PC 110 analyzes that other sounds are also existed through the frequency domain analyzing method, it represents that the sound leakage problem occurs between the second sound channel and the right channel sound-receiving interface 1221. The PC 110 can add the first testing audio signal of 2000 Hz into the first sound channel. When the PC 110 analyzes the right channel sound-receiving interface 1221, if it is detected that a sine wave of 2000 Hz exists, it represents that the sound leakage problem occurs between the first sound channel and the second sound channel, for example, under a situation that the first sound channel and the second sound channel are serially connected with each other.

Definitely, the PC 110 is not limited to using a specific sound frequency as the reference for detecting the sound leakage problem, and the PC 110 can also send different music segments via different sound channels. For example, the first music is played via the first sound channel, and the second music is played via the second sound channel. If the second music is detected in the first sound channel, the sound leakage problem occurs in the second sound channel.

Figure 4A:
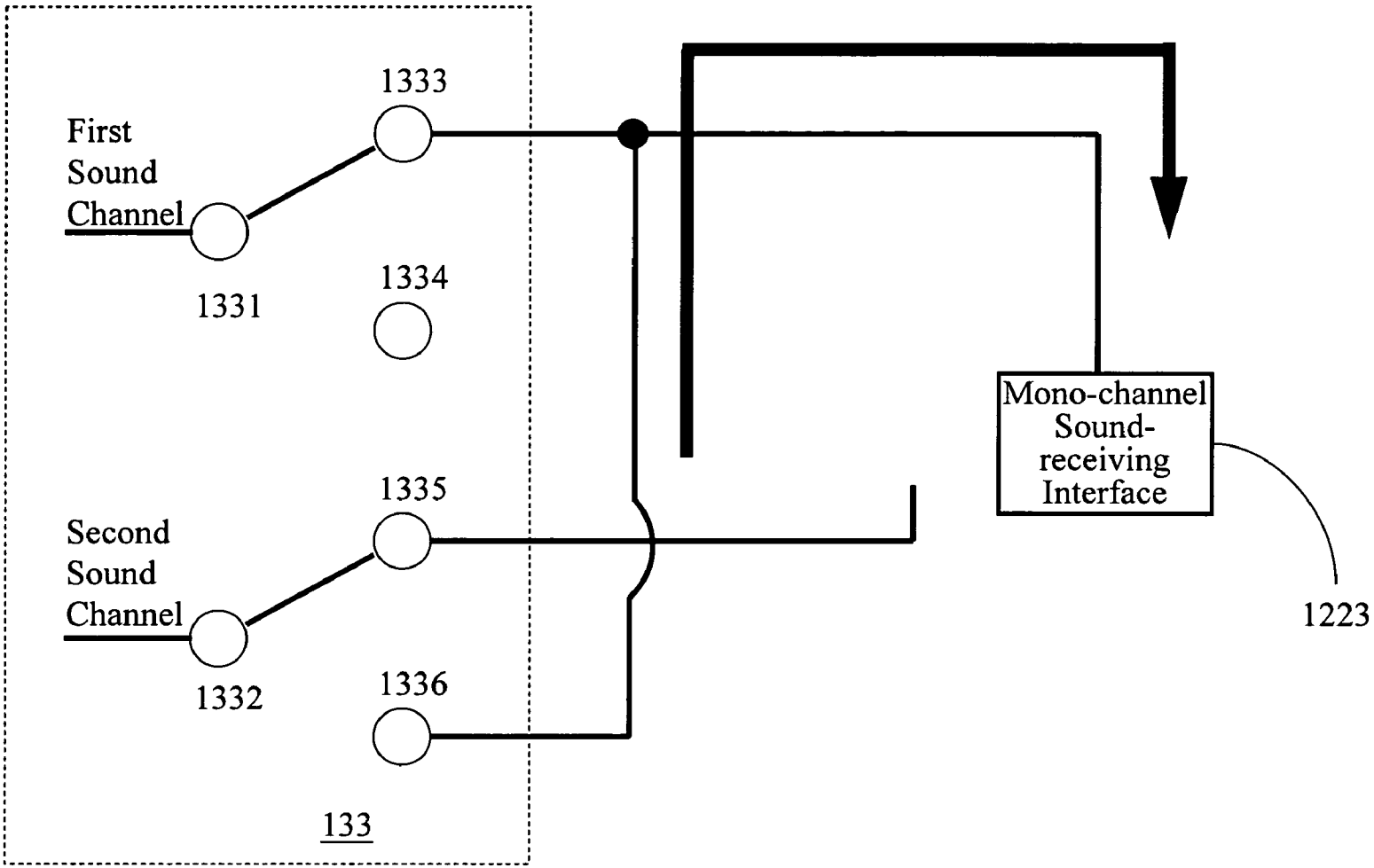
FIG. 4*a* is a demonstrative schematic view of the flow when the present invention is applied to a mono-channel sound-receiving unit according to an embodiment of the present invention.
Figure 4B:
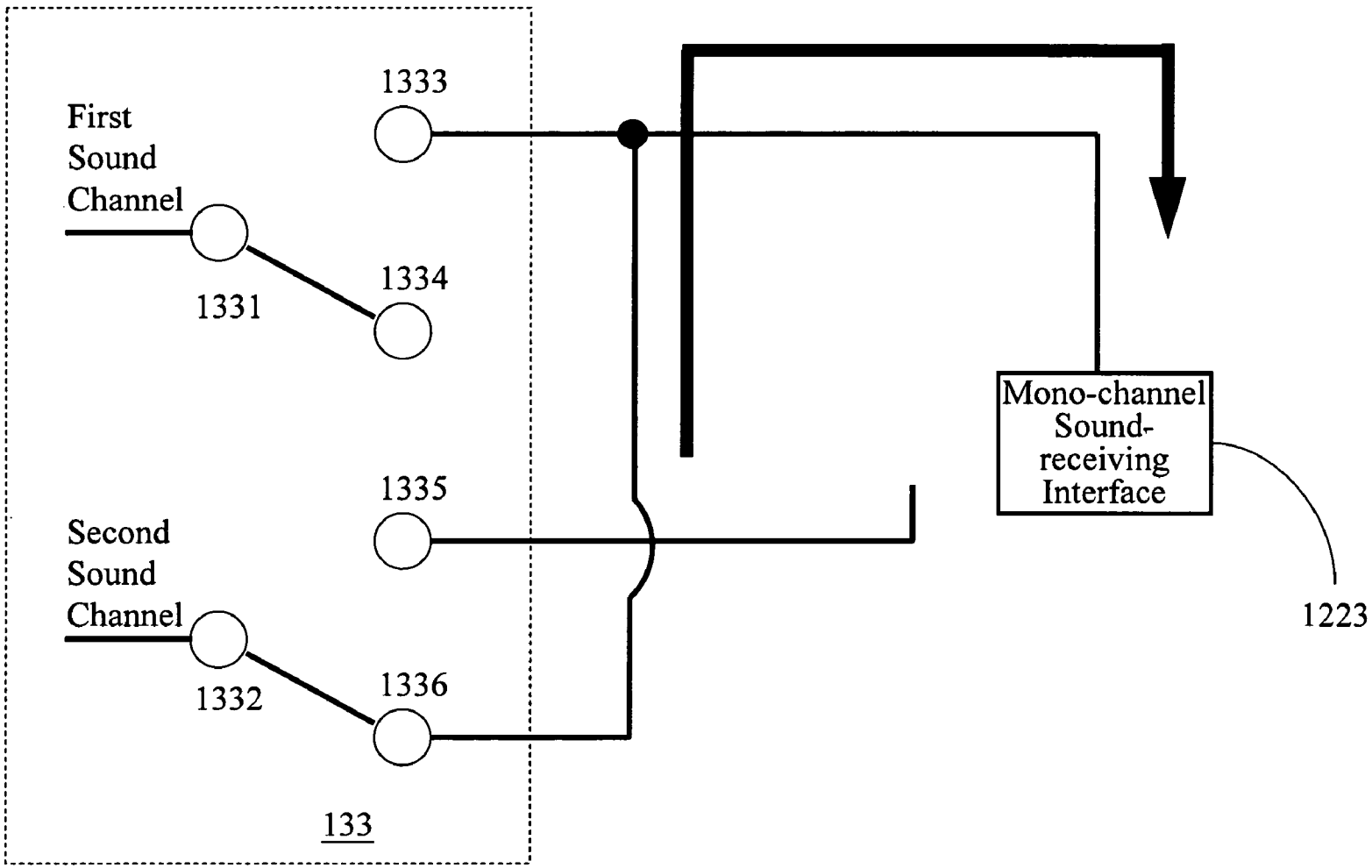
FIG. 4*b* is a demonstrative schematic view of the flow when the present invention is applied to the mono-channel sound-receiving unit according to an embodiment of the present invention.

Referring to FIGS. 4*a* and 4*b*, they are respectively demonstrative schematic views of the flow when the present invention is applied to a mono-channel sound-receiving unit according to an embodiment of the present invention. The difference between FIGS. 4*a* and 3*a* lies in the number of the corresponding sound channels for the sound-receiving interface 122 used for receiving. The sound-receiving interface 122 in FIG. 4*a* is a mono-channel sound-receiving interface 1223. Difference from the dual-channel sound-receiving interface, when the mono-channel sound-receiving interface 1223 and the testing apparatus 130 are connected, the practical depth of the mono-channel sound-receiving interface 1223 is shorter than that of the dual-channel sound-receiving interface, so an idle state is formed from the node 1335 to the mono-channel sound-receiving interface 1223, as shown in FIG. 4*a*.

When the first sound channel is tested, it is also assumed herein that the first testing audio signal is a sine wave of 20 Hz. The PC 110 sends the first testing audio signal via the first sound channel, and the first sound channel is connected to the mono-channel sound-receiving interface 1223, so the mono-channel sound-receiving interface 1223 can only receive the first testing audio signal. If the PC 110 analyzes that other sounds are also existed through the frequency domain analyzing method, it represents that the sound leakage problem occurs between the first sound channel and the mono-channel sound-receiving interface 1223. Next, the PC 110 can add the second testing audio signal of 2000 Hz into the second sound channel. When the PC 110 analyzes the mono-channel sound-receiving interface 1223, if it is in the normal condition, only the sine wave of 20 Hz exists. If it is detected that the sine wave of 2000 Hz also exists, it represents that the sound leakage problem occurs between the first sound channel and the second sound channel.

If it intends to test the second sound channel, the connecting manner of the transmitting paths can be obtained with reference to FIG. 4*b*. Firstly, the PC 110 sends the first switching audio signal and the second switching audio signal to respectively switch and connect the node 1331 to the node 1334, and to connect the node 1332 to the node 1336. At this time, the first sound channel is idle, which does not output any testing audio signal to the sound-receiving interface 122, and the second sound channel is connected to the mono-channel sound-receiving interface 1223.

Similarly, it is assumed that the second testing audio signal is a sine wave of 20 Hz. The PC 110 sends the second testing audio signal via the second sound channel, and the second sound channel is connected to the mono-channel sound-receiving interface 1223, so the mono-channel sound-receiving interface 1223 can only receive the second testing audio signal. If the PC 110 analyzes that other sounds are also existed through the frequency domain analyzing method, it represents that the sound leakage problem occurs between the second sound channel and the mono-channel sound-receiving interface. The PC 110 can add the first testing audio signal of 2000 Hz into the first sound channel. When the PC 110 analyzes the mono-channel sound-receiving interface 1223, if it is detected that a sine wave of 2000 Hz exists, it represents that the sound leakage problem occurs between the first sound channel and the second sound channel. The present invention provides a testing apparatus 130 and a testing method for detecting the sound card 120, which are applicable for detecting whether the sound leakage problem occurs in the sounding interface 121 of the sound card 120 in the PC 110. The switching unit 131 in the testing apparatus 130 not only can switch the received switching audio signals to the corresponding connecting circuit, but also the switching unit 131 is not limited to the fact that the sound-receiving interface is a mono-channel or a dual-channel.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for testing sound input and output of a sound card, applicable for detecting whether a sound leakage problem occurs in a sounding interface of a sound card in a personal computer (PC), wherein the sounding interface further comprises a first sound channel and a second sound channel, the testing apparatus comprising:

a switching circuit, electrically connected to the sounding interface and a sound-receiving interface of the sound card respectively, and having a plurality of transmitting paths, wherein the switching circuit is used to receive the first sound channel and the second sound channel, and connect the first sound channel and the second sound channel to corresponding transmitting paths, so as to transmit an audio signal back to the sound-receiving interface;

a test means, wherein the PC monitors a first testing audio signal transmitted via the first sound channel and/or a second testing audio signal transmitted via the second sound channel, and the PC examines whether the first sound channel has the second testing audio signal or whether the second sound channel has the first testing audio signal, so as to determine whether a sound leakage problem occurs between the first sound channel and the second sound channel; and a switching unit, electrically connected to the sounding interface and the switching circuit respectively, for receiving the first sound channel and the second sound channel, wherein the switching unit switches the transmitting paths in the switching circuit according to a first switching audio signal and/or a second switching audio signal.

2. The apparatus for testing sound input and output for the sound card as claimed in claim 1, wherein the switching unit further comprises a wave-shaping unit and a decoding unit, the wave-shaping unit receives the audio signal, and converts the audio signal into a switching signal, and the decoding unit switches connecting circuits in the switching unit according to the switching signal.

3. The apparatus for testing sound input and output of the sound card as claimed in claim 1, wherein the first switching audio signal is a waveform, a sine wave, or a piece of music.

4. The apparatus for testing sound input and output of the sound card as claimed in claim 1, wherein the second switching audio signal is a waveform, a sine wave, or a piece of music.

5. The apparatus for testing sound input and output of the sound card as claimed in claim 1, wherein the wave-shaping unit is a 555 timer.

6. The apparatus for testing sound input and output of the sound card as claimed in claim 1, wherein the decoding unit is a PT2272 decoder.

7. A method for testing sound input and output of a sound card, applicable for detecting whether a sound leakage problem occurs in a sounding interface of a sound card in a PC, wherein the sounding interface comprises a first sound channel and a second sound channel respectively, the testing method comprising:

providing a switching unit and a switching circuit, wherein the switching unit is electrically connected to the sounding interface and the switching circuit respectively, and the switching circuit is electrically connected to the sounding interface and a sound-receiving interface in the sound card respectively;

sending a first switching audio signal to the first sound channel or the second sound channel by the PC;

altering transmitting paths in the switching circuit by the switching unit according to the first switching audio signal, wherein the switching circuit connects the first sound channel and the second sound channel to the corresponding transmitting paths, so as to transmit the audio signal back to the sound-receiving interface; and monitoring whether the first sound channel has a testing audio signal transmitted via the second sound channel and whether the second sound channel has a testing audio signal transmitted via the first sound channel.

8. The method for testing sound input and output of the sound card as claimed in claim 7, wherein the first switching audio signal is a waveform, a sine wave, or a piece of music.

9. The method for testing sound input and output of the sound card as claimed in claim 7, further comprising: providing a second switching audio signal, wherein the second switching audio signal is used to switch connecting circuits of the second sound channel to the PC, and the second switching audio signal is a waveform, a sine wave, or a piece of music.

10. The method for testing sound input and output of the sound card as claimed in claim 7, wherein the switching unit further comprises a wave-shaping unit and a decoding unit, the wave-shaping unit receives the audio signal and converts the audio signal into a switching signal, and the decoding unit switches the connecting circuits in the switching unit according to the switching signal.

11. The method for testing sound input and output of the sound card as claimed in claim 7, wherein according to a frequency domain comparison process, the PC determines whether the audio signal received by the equipment under test is consistent with the audio signal sent via the sound channel, so as to determine an operation state of the sound channel.

12. The method for testing sound input and output of the sound card as claimed in claim 11, wherein the frequency domain comparison process is a Fourier convert, a wavelet convert, or designs of discrete cosine convert.

13. The method for testing sound input and output of the sound card as claimed in claim 7, wherein the sound-receiving interface is a mono-channel sound input or a dual-channel sound input.

* * * * *